US011559087B2

(12) United States Patent
Maier

(10) Patent No.: US 11,559,087 B2
(45) Date of Patent: Jan. 24, 2023

(54) CYCLING GARMENT WITH A SEAT PAD

(71) Applicant: ASSOS OF SWITZERLAND GMBH, San Pietro di Stabio (CH)

(72) Inventor: Roger Maier, Carona (CH)

(73) Assignee: ASSOS OF SWITZERLAND GMBH, San Pietro di Stabio (CH)

( * ) Notice: Subject to any disclaimer, the term of this patent is extended or adjusted under 35 U.S.C. 154(b) by 127 days.

(21) Appl. No.: 16/453,018

(22) Filed: Jun. 26, 2019

(65) Prior Publication Data

US 2020/0000157 A1 Jan. 2, 2020

(30) Foreign Application Priority Data

Jun. 27, 2018 (EP) ..... 18180125

(51) Int. Cl.
*A41D 1/084* (2018.01)

(52) U.S. Cl.
CPC ..... *A41D 1/084* (2013.01); *A41D 2600/104* (2013.01)

(58) Field of Classification Search
CPC ..... A41D 1/084; A41D 2600/104; A41D 13/0537; A41D 1/088
USPC ..... 2/228, 267
See application file for complete search history.

(56) References Cited

U.S. PATENT DOCUMENTS 4,805,243 A * 2/1989 Gibbens ..... A41D 1/084 2/228
5,271,101 A * 12/1993 Speth ..... A41D 1/084 2/214
5,365,610 A * 11/1994 Lubahn ..... A41D 13/015 2/227
6,807,685 B1 * 10/2004 Hasegawa ..... A41B 9/04 2/406
7,707,659 B2 * 5/2010 Africa ..... A41D 1/084 2/267
7,739,754 B2 * 6/2010 Garneau ..... A41D 13/0537 2/466
8,042,197 B2 * 10/2011 Maier ..... A41D 1/084 2/228
8,087,097 B2 * 1/2012 Maier ..... A41D 1/084 2/227
2001/0052146 A1 * 12/2001 Garneau ..... A41D 1/084 2/455
2003/0079276 A1 * 5/2003 Forsyth ..... A41D 1/084 2/267

(Continued)

FOREIGN PATENT DOCUMENTS

CA 2781769 A1 * 6/2011 ..... A41D 1/084
EP 0776615 A2 * 6/1997 ..... A41D 1/084

(Continued)

OTHER PUBLICATIONS

European Search Report mailed in EP Application No. 18180125.9-1017 dated Nov. 26, 2018.

*Primary Examiner* — Alissa L Hoey
(74) *Attorney, Agent, or Firm* — Fox Rothschild LLP

(57) ABSTRACT

A cycling garment comprising a seat pad, wherein the seat pad comprises a cover and at least one shaped pads respect to a median longitudinal axis of the seat pad, wherein the seat pad is attached to the cycling garment along at least part of the perimeter of said cover, and the seat pad is also attached to the garment with a crotch attachment located in the rear portion of the seat pad.

8 Claims, 3 Drawing Sheets

(56) References Cited

U.S. PATENT DOCUMENTS

| | | | | |
|---|---|---|---|---|
| 2010/0095432 | A1* | 4/2010 | Liou | A41D 1/084 2/227 |
| 2010/0095442 | A1* | 4/2010 | Kuipers | A41D 1/084 2/466 |
| 2014/0165272 | A1* | 6/2014 | Chen | A41D 1/084 2/466 |
| 2014/0366254 | A1* | 12/2014 | Maier | A41D 1/084 2/466 |
| 2015/0075538 | A1* | 3/2015 | Samuel | A41B 9/02 128/845 |
| 2015/0313292 | A1* | 11/2015 | Knopik | A41D 27/24 2/228 |
| 2016/0317364 | A1* | 11/2016 | Evenson | A61F 13/49011 |
| 2016/0353811 | A1* | 12/2016 | Wallace | A41D 1/084 |
| 2017/0135420 | A1* | 5/2017 | Peng | A41D 1/084 |
| 2019/0343195 | A1* | 11/2019 | Stewart | A41D 27/24 |

FOREIGN PATENT DOCUMENTS

| | | | | |
|---|---|---|---|---|
| EP | 1430797 | A2 | 6/2004 | |
| EP | 2494878 | A1 * | 9/2012 | A41D 1/088 |
| EP | 2810574 | A1 * | 12/2014 | A41D 1/084 |
| EP | 2878217 | A1 * | 6/2015 | A41D 1/084 |
| EP | 3571945 | A1 * | 11/2019 | A41F 3/04 |
| EP | 3725174 | A1 * | 10/2020 | A41D 1/084 |
| WO | 2011/063503 | | 6/2011 | |

* cited by examiner

CYCLING GARMENT WITH A SEAT PAD

FIELD OF APPLICATION

The present invention relates to cycling garments.

BACKGROUND ART

Most cycling garments include a seat pad in the crotch area. The basic task of a seat pad is to dampen the contact of the ischiatic region with the saddle.

Seat pads are produced in a variety of shapes. For example, the seat pad can be specifically designed for road biking, mountain biking, etc. as well as for the male or female anatomy.

In general terms, however, a seat pad includes a base panel, also termed cover, and one or more shaped pads made of a suitable soft material, for example a foam material.

The cover may include one or more fabric layers.

The shaped pads may include shaped pads of a different shape, thickness or density, to provide a differentiated support on various zones of the saddle.

The shaped pads are normally symmetric around a longitudinal line of symmetry of the seat pad. The shaped pads may be fixed to the cover by stitching, hot sealing, gluing or another equivalent technique.

According to the prior art, the seat pad is attached to the cycling garment by attaching the perimetric edge of the cover to the inside of the cycling garment.

The prior art has faced the problem of maintaining a proper position of the seat pad during the use, which is crucial to the performance. Advanced seat pads with a complex design, for example with a distribution of zones of different density, are particularly sensitive to this problem. The seat pad must be maintained in a proper orientation and alignment relative to the garment; at the same time, however, it should have a certain freedom to follow the pedalling movement. A critical condition is represented by pedalling out of the saddle. In such a condition, the seat pad may shift away from the proper alignment.

Several solutions have been proposed in the prior art for improving the connection of the seat pad to the cycling suit. Among others, EP 1430797 discloses cycling shorts with a seat pad attached to the shorts at selected points distributed along the edge of the cover. EP 2494878 discloses a cycling garment comprising a seat pad wherein only a front portion and a rear portion of the seat pad are attached to the garment, leaving a loose central portion free of attachment, to better follow the pedalling movement.

In addition, the prior art has faced the problem of maintaining a proper alignment of the shaped pads. As the cover is made of an elastic, soft material, the elastic deformation of the cover may result in the shaped pads departing from the optimal position. Particularly, under intense pedalling, the shaped pads can move away from each other. To obviate this drawback, EP 2055202 discloses a seat pad comprising a substantially unstretchable insert to connect the shaped pads.

The above mentioned solutions work well and are satisfactory in most cases; there is however a continuous effort to improve the performance of cycling garments. Accordingly, the aim of the present invention is to further ameliorate the technique of the fixation of a seat pad to a cycling garment.

SUMMARY OF THE INVENTION

The present invention aims to a further improvement of cycling garments including a seat pad, with a view to improve the stability of the seat pad, particularly of the cover and of the related shaped pads, during the use.

The above aim is reached with a cycling garment according to claim 1.

The garment includes a crotch attachment preferably in addition to a perimetric attachment of the seat pad.

The crotch attachment is locate outside of a padded region of the seat pad. For example, in some embodiments the crotch attachment is between two shaped pads which form said shaped region.

Being located outside the padded region, the crotch attachment does not affect the thickness of the padding of the seat pad. The padding thickness of the seat pad is not reduced in the region of the crotch attachment and the crotch attachment does not generate any potential source of friction.

The crotch attachment may include only one attachment line or a plurality of attachment lines, according to various embodiments of the invention. Any reference to said crotch attachment, in this description, shall be understood to a unique attachment line or to multiple attachment lines, according to different embodiments of the invention.

In some embodiments, said crotch attachment includes an attachment line which is parallel to, or coincident with, a longitudinal anterior-posterior median line of the seat pad. Said median line identifies a left part and a right part of the seat pad. Said median line is preferably a line of symmetry of the seat pad, which means that said left part and right part preferably mirror one another.

The seat pad can be planar or modelled with an appropriate shape, e.g. a saddle-like curved shape. Accordingly said median line can be a straight line, i.e. a straight longitudinal axis, or a curvilinear line following a curvature of the seat pad, for example of the cover. Also the crotch attachment may include straight lines and/or curved lines according to various embodiments.

In an embodiment, sad median line is a line of symmetry of the seat pad.

In an embodiment, said crotch attachment is located between two padded regions of the seat pad. According to various embodiments, said two padded regions may be part of two shaped pads attached to the cover or may be part of a single pad, e.g. a three-lobed pad with a front lobe and two posterior left/right lobes.

In a preferred embodiment, the seat pad comprises two pads each including a front portion extending towards the front of the seat pad and a rear lobe larger than the front portion, and said padded regions are part of said rear lobes.

The crotch attachment is located in the rear portion of the seat pad. The crotch attachment may include one or more attachment lines. The number, length and location of said attachment line(s) may vary according to different embodiments of the invention.

The crotch attachment is entirely located in the rear portion of the seat pad. In an embodiment, said crotch attachment is in a mid-rear portion of the seat pad. In a preferred embodiment, said crotch attachment is close to the rear edge of the seat pad. Preferably, said crotch attachment line does not reach the rear edge of the seat pad.

Preferably, the crotch attachment includes, or consists of, an attachment line having a length of 10% to 40% of the length (longitudinal extension) of the seat pad, more preferably 10% to 20%.

The longitudinal location of an attachment line can be defined with a longitudinal coordinate according to a median longitudinal line of the seat pad. For example, the coordinate can be set to 0 at an intersection of said line with the rear edge of the seat pad, and to 1 at an intersection of said line with the front edge. According to this coordinate system, and in a preferred embodiment of the invention, the crotch attachment includes or consists of an attachment line lying entirely in the coordinate range of 0.05 to 0.45, preferably 0.10 to 0.30.

The crotch attachment line may include continuous or discontinuous attachment lines. A discontinuous attachment line can be made of several discrete attachment points, from a first end attachment point to a second end attachment point. Said attachment points may be equally spaced or not, according to various embodiments.

According to preferred embodiments, said crotch attachment includes any of: stitching, welding, gluing.

A particularly preferred embodiment has only one attachment line. More preferably, this unique attachment line is directed according to a longitudinal median line of the seat pad. More preferably this unique attachment line is a continuous attachment line, e.g. a continuous line of stitching.

The perimeter attachment of the seat pad to the garment can be made with any known technique. For example, the perimeter attachment can be continuous or discrete. The perimeter attachment can also be made only on a front portion and rear portion, according to the above mentioned teaching of EP 2494878.

A preferred material for the garment is elastane fibre.

The cover of the seat pad may include a plurality of layers. In some embodiments the cover of the seat pad includes at least one fabric layer and a layer of a soft material such as open-cell foam material. For example in a particularly preferred embodiment the cover of the seat pad includes a layer of a soft material sandwiched between two fabric layers.

The shaped pads can also be made of a foam material.

In a particularly preferred embodiment, the crotch attachment of the invention is combined with a perimetric attachment as disclosed in EP 2494878 wherein only a front portion and a rear portion of the seat pad are attached to the garment, leaving a loose central portion free of attachment. In such a case the crotch attachment is preferably located in the region of the rear portion of perimetric attachment for best synergy with the discontinuous perimetric attachment.

The additional fixation provided by the mid-rear crotch attachment, in addition to the perimetric attachment, is particularly advantageous to maintain a proper position and orientation of the seat pad.

The additional crotch attachment of the invention is strategically in the rear portion of the seat pad, between the rear padded regions which are designed to support the ischiatic region. Being close to said rear padded regions, this additional attachment enhances the support of said padded regions and prevents their deviation from the optimum position, keeping the proper orientation and alignment. At the same time, however, the additional attachment is relatively small (e.g. a short line) compared to the size and length of the seat pad and therefore does not obstacle the pedalling movement leaving the seat pad free to follow the body of the rider.

The crotch attachment line acts as a horizontal stabilizer of the seat pad. Particularly, the crotch attachment of the invention eliminates shifting while pedalling out of the saddle.

A feature of the invention is that the crotch attachment does not modify the thickness of the seat pad and, therefore, does not interfere with pedalling. It has to be noted that any variation of thickness (step) may cause friction and be a source of discomfort.

Still another advantage of the invention is that the additional attachment maintains a proper position of the cover of the seat pad.

Another advantage is that the peeling of the cycling trousers is reduced.

The feature and the advantages of the invention will be elucidated with the help of the following description of a preferred embodiment and with reference to the attached drawings.

DESCRIPTION OF PREFERRED EMBODIMENTS

Figure 1:
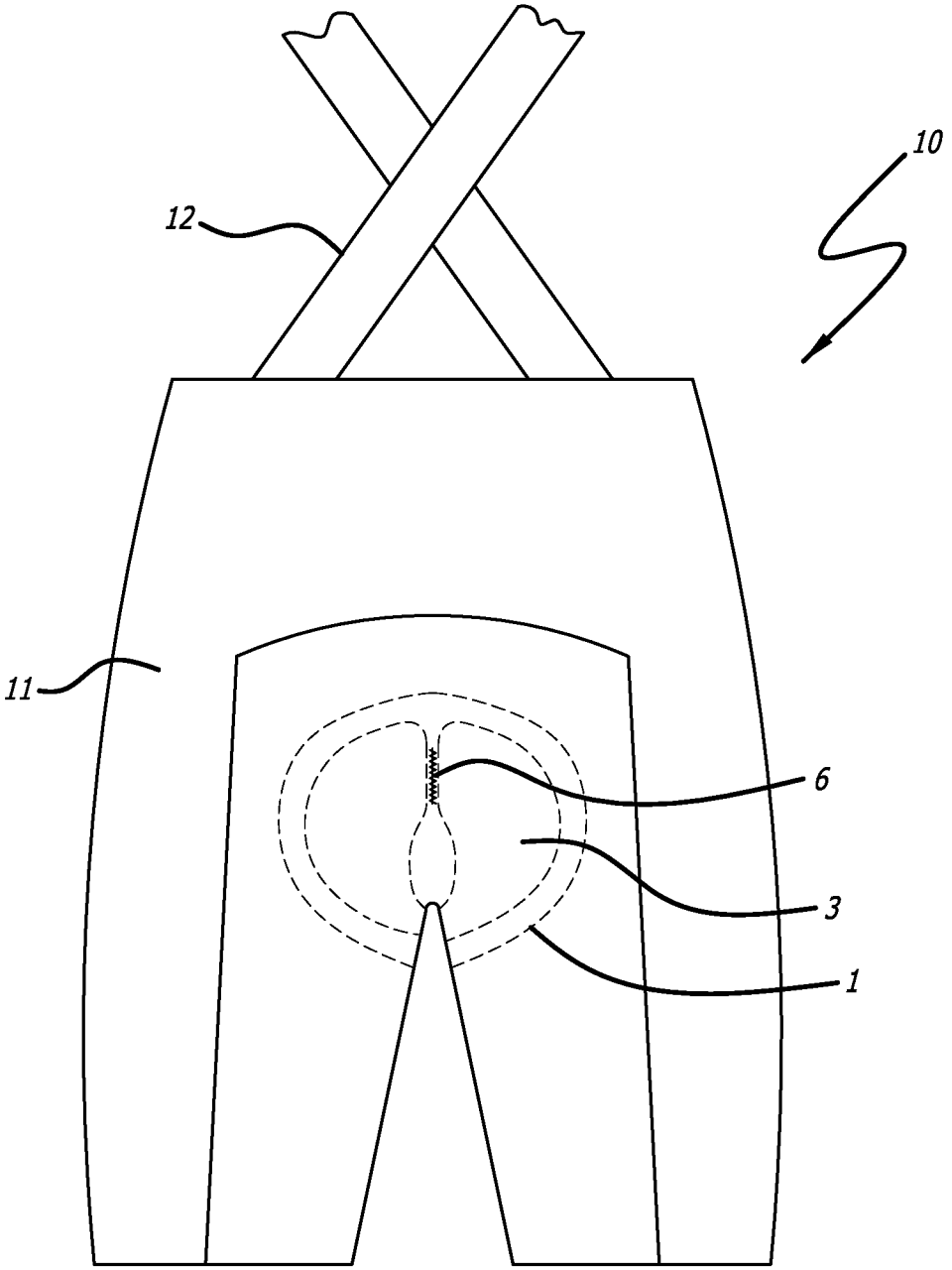
FIG. 1 is a partial view of a garment including a seat pad according to an embodiment of the invention. of FIG. 1.

FIG. 1 illustrates a cycling garment, for example a cycling bib 10, including a seat pad 1 in the crotch area. The cycling bib 10 includes a pair of shorts 11 and suspenders 12. The shorts 11 are made of various fabric panels, connected together.

The seat pad 1 (FIG. 2) comprises a cover 2 and two shaped pads 3 attached (e.g. stitched) to the cover 2. The two shaped pads 3 provide a padded region 9 of the seat pad, which extends over part of the surface of the cover 2.

The cover 2 may be a single-layer fabric panel or may comprise multiple layers. For example, in an embodiment, the cover 2 includes an inner layer for contact with the skin, an outer layer, and optionally also an intermediate soft layer. One or more layers may be perforated to expel water vapour and provide a proper circulation of air.

The cover 2 may also include a front window 4 specifically designed for accommodation and/or ventilation of the genital area. For example the front window 4 may be perforated or specifically realized with a single layer of fabric.

The seat pad 1 is symmetric relative to a longitudinal median line A-A. This median line A-A can be a straight axis when the cover 2 lies on a plane. In some embodiments the cover 2 has its own shape and the line A-A may be a curvilinear line of symmetry following a curvature of the cover 2.

The seat pad 1 is attached to the crotch area of the cycling bib 10 along at least part of the perimeter 5 of the seat pad. The perimetric attachment may be continuous or discontinuous. Various embodiments include: a connection over the full perimeter, a connection at discrete points distributed over the perimeter; a connection only in the front portion and rear portion.

Further to the perimetric attachment, along all or part (a front perimetric attachment and a rear perimetric attachment) of the perimeter 5, the seat pad is also attached to the bib 10 via a crotch attachment line 6 located in the rear portion of the seat pad 1.

The attachment line 6 is located outside of the padded region of the seat pad. In the example, the attachment line 6 is located between the shaped pads 3. As a consequence, the thickness of the padded region of the seat pad is not affected by said attachment line 6.

In the illustrated embodiment, the shaped pads 3 include front portions 7, narrowing towards the front of the seat pad, and larger rear lobes 8 designed to provide support to the ischiatic bones. Said attachment line 6 is located in the mid-rear part of the seat pad, between the rear lobes 8.

Preferably, said attachment line 6 lies on the median line A-A, thus being in the centre of the seat pad 1.

The perimetric attachment, along all or part (a front perimetric attachment and a rear perimetric attachment) of the perimeter 5, and the additional attachment line 6, connect the seat pad 1 to one or more fabric panels of a cycling garment.

Figure 2:
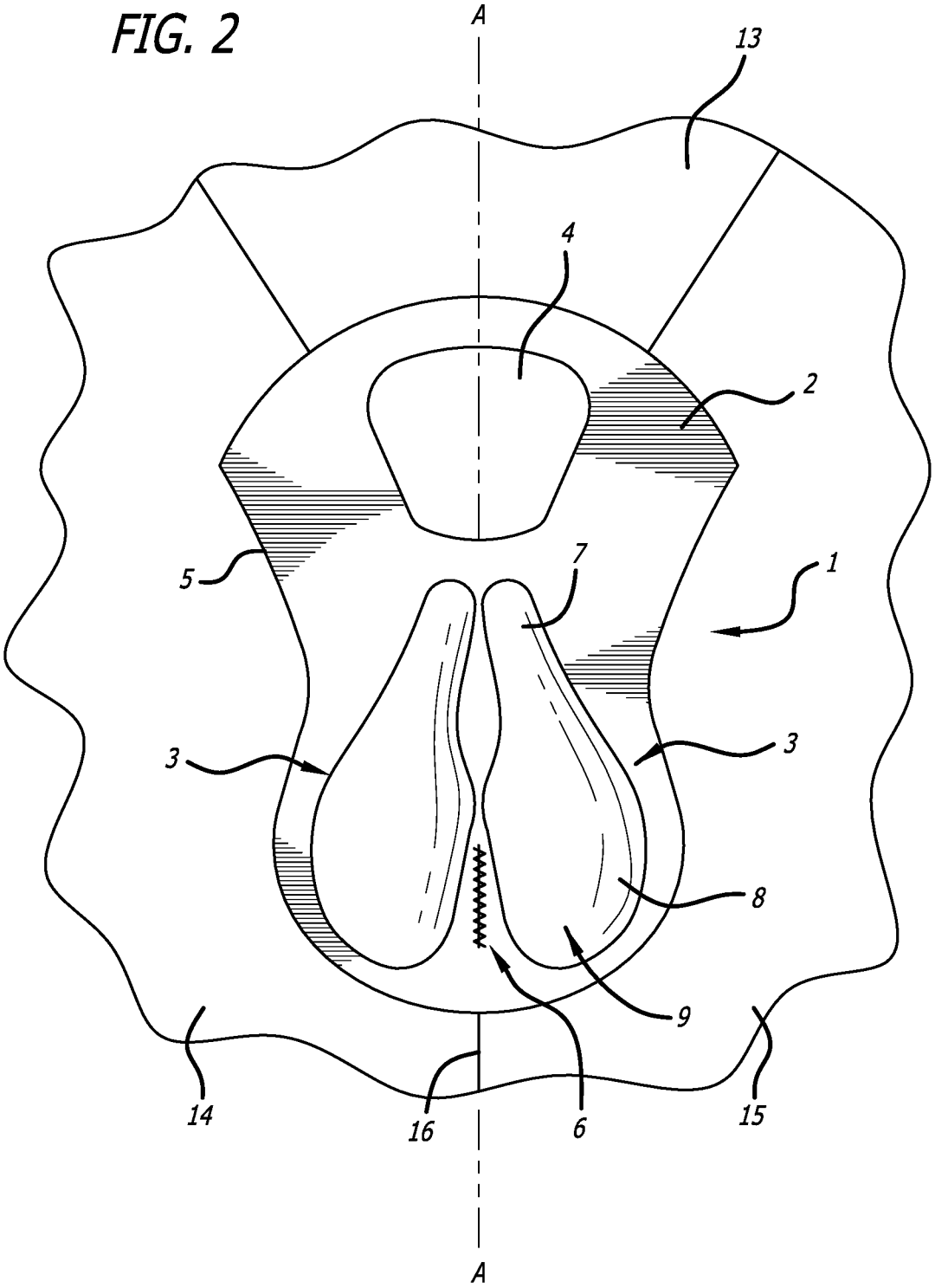
FIG. 2 is a view of the inside of the garment of FIG. 1, showing the seat pad and its connection to the cycling garment.

It can be appreciated from FIG. 2 that the line 6 provides an additional region of fixation of the seat pad to the garment which is strategically located between the shaped pads 3 and in the rear portion of the seat pad.

Preferably, as illustrated, the cover 2 is attached to a front panel 13 and lateral panels 14, 15 of the shorts 11. The lateral panels 14, 15 are joined at a line 16. Preferably said attachment line 6 is coincident with the joint line 16.

The attachments of the seat pad to the garment 10, including the attachment line 6, are made for example by stitching.

FIG. 1 illustrates the position of the seat pad 1, shaped pads 3 and attachment line 6 in the cycling bib 10.

The length of the attachment line is preferably 20% to 40% of the length of the seat pad, according to the axis A-A.

Figure 3:
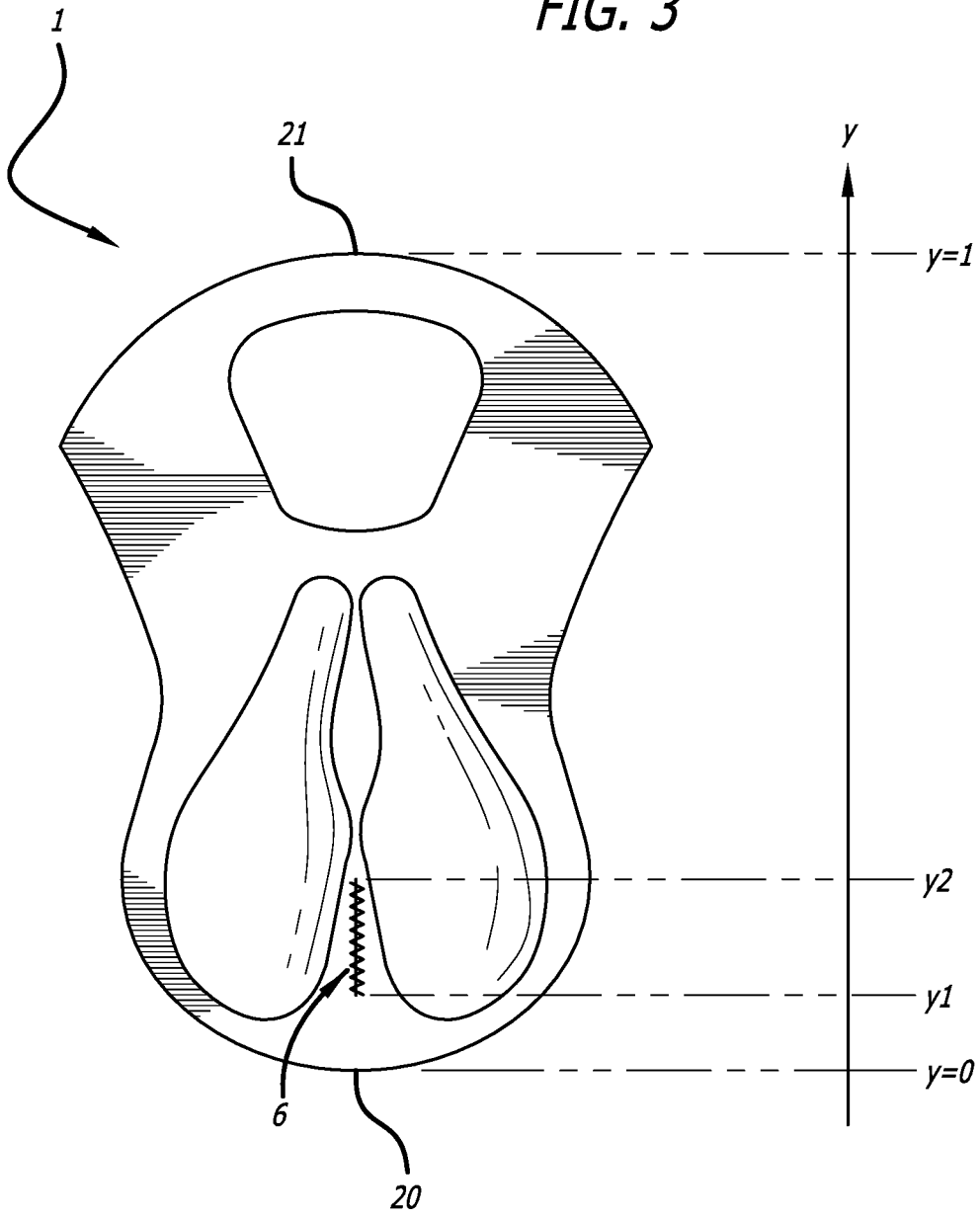
FIG. 3 is a view of the seat pad in a preferred embodiment.

FIG. 3 illustrates the position of the attachment line 6 in a preferred embodiment. As stated above, said line 6 is preferably in a mid-rear position. In a greater detail, FIG. 3 illustrates a coordinate y wherein y=0 denotes the bottom centre 20 and y=1 denotes the front centre 21 of the seat pad.

The line 6 starts at a coordinate y1 and ends at y2. Preferably the entire line 6 lies in the region of y being 0.05 to 0.45, preferably 0.1 to 0.30. More preferably, y1 is 0.05 to 0.10 and y2 is 0.25 to 0.40.

In use, the additional fixation provides by the line 6 helps keeping the shaped pads 3, particularly the ischiatic lobes 8, in their proper working position. Also the cover 2 becomes more stable thanks to the central fixation of line 6. Accordingly, the adherence and performance of the seat pad 1 are improved. The seat pad 1 is stabilized horizontally.

The invention claimed is:

1. A cycling garment comprising a seat pad, wherein the seat pad comprises a cover and at least two rear pads associated to the cover and positioned respectively right and left of the seat pad, leaving an unpadded region in between, wherein the seat pad has a perimetric attachment to the garment, made along edges of the seat pad, including a front perimetric attachment and a rear perimetric attachment, the front perimetric attachment extends continuously along a front edge of the seat pad and the rear perimetric attachment extends continuously along a rear edge of the seat pad, wherein a central edge of the seat pad, which is located between said front edge and rear edge, is not attached to the garment, the garment further comprising an additional attachment line which is located centrally in a rear portion of the seat pad, wherein said additional attachment line is a non-perimetric connection made over a surface portion of the cover of the seat pad to join the cycling garment and the cover of the seat pad, and is located in the aforesaid unpadded region between said two rear pads, wherein said additional attachment line is spaced from the rear perimetric attachment located at a longitudinal center line of the cover.

2. The cycling garment according to claim 1, wherein said additional attachment line is parallel to, or coincident with, a longitudinal anterior-posterior median line of the seat pad and wherein said median line is a line of symmetry of the seat pad.

3. The cycling garment according claim 1, wherein said additional attachment line is coincident with a line of connection of two fabric panels of the garment.

4. The cycling garment according to claim 1, wherein said additional attachment line has a length of 10% to 40% of the length of the seat pad, preferably 10% to 20%.

5. The cycling garment according to claim 1 wherein: given a longitudinal coordinate according to a median longitudinal line of the seat pad, the coordinate being 0 at an intersection of said line with the rear edge of the seat pad, and the coordinate being 1 at an intersection of said line with the front edge, the additional attachment line extends in the coordinate range of 0.05 to 0.45, preferably 0.1 to 0.25.

6. The cycling garment according to claim 1, wherein said additional attachment line is a continuous attachment line, or comprises several discrete attachment points.

7. The cycling garment according to claim 1, said additional attachment line including any of: stitching, welding, gluing.

8. The cycling garment according to claim 1 wherein said additional attachment line consists of only one attachment line.

* * * * *